US011828260B2

(12) United States Patent
Miyake et al.

(10) Patent No.: US 11,828,260 B2
(45) Date of Patent: Nov. 28, 2023

(54) INTERNAL COMBUSTION ENGINE IGNITION DEVICE

(71) Applicant: DENSO CORPORATION, Kariya (JP)

(72) Inventors: Keiko Miyake, Kariya (JP); Takashi Ohno, Kariya (JP)

(73) Assignee: DENSO CORPORATION, Kariya (JP)

( * ) Notice: Subject to any disclaimer, the term of this patent is extended or adjusted under 35 U.S.C. 154(b) by 70 days.

(21) Appl. No.: 17/704,664

(22) Filed: Mar. 25, 2022

(65) Prior Publication Data

US 2022/0213858 A1 Jul. 7, 2022

Related U.S. Application Data

(63) Continuation of application No. PCT/JP2020/029937, filed on Aug. 5, 2020.

(30) Foreign Application Priority Data

Sep. 26, 2019 (JP) ..... 2019-174921

(51) Int. Cl.
*F02P 5/145* (2006.01)
*F02P 3/05* (2006.01)

(52) U.S. Cl.
CPC ..... *F02P 3/051* (2013.01); *F02P 5/145* (2013.01)

(58) Field of Classification Search
CPC .. F02P 3/051; F02P 3/053; F02P 5/145; F02P 5/1502; F02P 9/007; F02P 17/12
USPC ..... 123/605, 618, 621, 623, 644, 649, 650, 123/651, 652, 653, 654
See application file for complete search history.

(56) References Cited

U.S. PATENT DOCUMENTS

| | | | |
|---|---|---|---|
| 4,892,080 | A | 1/1990 | Morino et al. |
| 2016/0102648 | A1 | 4/2016 | Nakayama et al. |
| 2020/0049120 | A1 | 2/2020 | Ohno |

FOREIGN PATENT DOCUMENTS

| | | | |
|---|---|---|---|
| JP | S61129466 | A | 6/1986 |
| JP | H01232165 | A | 9/1989 |
| JP | 2015-17544 | | 1/2015 |
| JP | 2018-84209 | | 5/2018 |
| JP | 2018178997 | A | 11/2018 |
| WO | 2017/006487 | | 1/2017 |

*Primary Examiner* — Hai H Huynh
(74) *Attorney, Agent, or Firm* — Nixon & Vanderhye P.C.

(57) ABSTRACT

An internal combustion engine ignition device includes an ignition coil, an ignition plug, a main ignition circuit, and an energy input circuit. A first switching element of the main ignition circuit performs energization and interruption of energization to a first coil part of a primary coil to generate an induced electromotive force using a DC voltage. A second switching element of the energy input circuit performs energization and interruption of energization to a second coil part of the primary coil to keep a discharge current in a secondary coil within an intended range directly using the DC voltage, after the induced electromotive force has been generated. A soft-off circuit of the energy input circuit slows a turn-off speed of the second switching element. The energy input circuit is configured to, when decreasing a signal voltage added to a gate of the second switching element, execute a first decreasing stage of decreasing the signal voltage until it reaches the vicinity of a gate-source threshold voltage and a second decreasing stage of gradually decreasing the signal voltage in the vicinity of the threshold voltage.

5 Claims, 13 Drawing Sheets

INTERNAL COMBUSTION ENGINE IGNITION DEVICE

CROSS-REFERENCE TO RELATED APPLICATION

This application is the U.S. bypass application of International Application No. PCT/JP2020/029937 filed on Aug. 5, 2020, which designated the U.S. and claims priority to Japanese Patent Application No. 2019-174921, filed on Sep. 26, 2019, the contents of both of which are incorporated herein by reference.

TECHNICAL FIELD

The present disclosure relates to an internal combustion engine ignition device.

BACKGROUND

An internal combustion engine ignition device includes an ignition coil having a primary coil and a secondary coil, an ignition plug for generating a spark discharge in a combustion chamber of an internal combustion engine by the ignition device, an ignition circuit to perform energization and interruption of energization to the primary coil, and others. Also, after an induced electromotive force has been generated in the secondary coil in response to interruption of energization to the primary coil, a discharge current by the induced electromotive force is maintained to lengthen a discharge time of the spark discharge in the ignition plug.

SUMMARY

A first aspect of the present disclosure is an internal combustion engine ignition device including an ignition coil having a primary coil to be applied with a DC voltage by a DC power source and a secondary coil to generate an induced electromotive force in response to interruption of energization to the primary coil, an ignition plug for generating a spark discharge in a combustion chamber of an internal combustion engine by the induced electromotive force, a main ignition circuit having a first switching element that performs energization and interruption of energization to a first coil part, which constitutes at least a portion of the primary coil, for generating the induced electromotive force using the DC voltage, and an energy input circuit having a second switching element that performs energization and interruption of energization to a second coil part, which constitutes at least a portion of the primary coil, for keeping a discharge current in the secondary coil within an intended range directly using the DC voltage after the induced electromotive force has been generated, and a soft-off circuit to slow a turn-off speed of the second switching element.

The energy input circuit is configured to, when decreasing a signal voltage added to a gate of the second switching element, execute a first decreasing stage of decreasing the signal voltage until it reaches the vicinity of a gate-source threshold voltage and a second decreasing stage of gradually decreasing the signal voltage in the vicinity of the threshold voltage.

A second aspect of the present disclosure is an internal combustion engine ignition device including an ignition coil having a primary coil to be applied with a DC voltage by a DC power source and a secondary coil to generate an induced electromotive force in response to interruption of energization to the primary coil, an ignition plug for generating a spark discharge in a combustion chamber of an internal combustion engine by the induced electromotive force, a main ignition circuit having a first switching element that performs energization and interruption of energization to a first coil part, which constitutes at least a portion of the primary coil, for generating the induced electromotive force using the DC voltage, and an energy input circuit having a second switching element that performs energization and interruption of energization to a second coil part, which constitutes at least a portion of the primary coil, for keeping a discharge current in the secondary coil within an intended range directly using the DC voltage after the induced electromotive force has been generated, the energy input circuit being configured to make a turn-off speed of the second switching element slower than a turn-on speed of the second switching element.

The energy input circuit is configured to, when decreasing a signal voltage added to a gate of the second switching element, execute a first decreasing stage of decreasing the signal voltage until it reaches the vicinity of a gate-source threshold voltage and a second decreasing stage of gradually decreasing the signal voltage in the vicinity of the threshold voltage.

A third aspect of the present disclosure is an internal combustion engine ignition device including an ignition coil having a primary coil to be applied with a DC voltage by a DC power source and a secondary coil to generate an induced electromotive force in response to interruption of energization to the primary coil, an ignition plug for generating a spark discharge in a combustion chamber of an internal combustion engine by the induced electromotive force, a main ignition circuit having a first switching element that performs energization and interruption of energization to a first coil part, which constitutes at least a portion of the primary coil, for generating the induced electromotive force using the DC voltage, and an energy input circuit having a second switching element that controls an energization state to a second coil part, which constitutes at least a portion of the primary coil, for keeping a discharge current in the secondary coil at an intended value directly using the DC voltage after the induced electromotive force has been generated, the energy input circuit being configured to maintain a state in which a voltage applied to the second coil part by the second switching element is lower than the DC voltage.

The energy input circuit is configured to gradually increase a gate-source voltage of the second switching element in the vicinity of a threshold voltage thereby to limit and gradually increase a current flowing between the drain and the source of the second switching element, such that the discharge current of the secondary coil is kept at a certain value.

BRIEF DESCRIPTION OF THE DRAWINGS

The above features of the present disclosure will be made clearer by the following detailed description, given referring to the appended drawings. In the accompanying drawings.

DETAILED DESCRIPTION OF THE PREFERRED EMBODIMENTS

Figure 1:
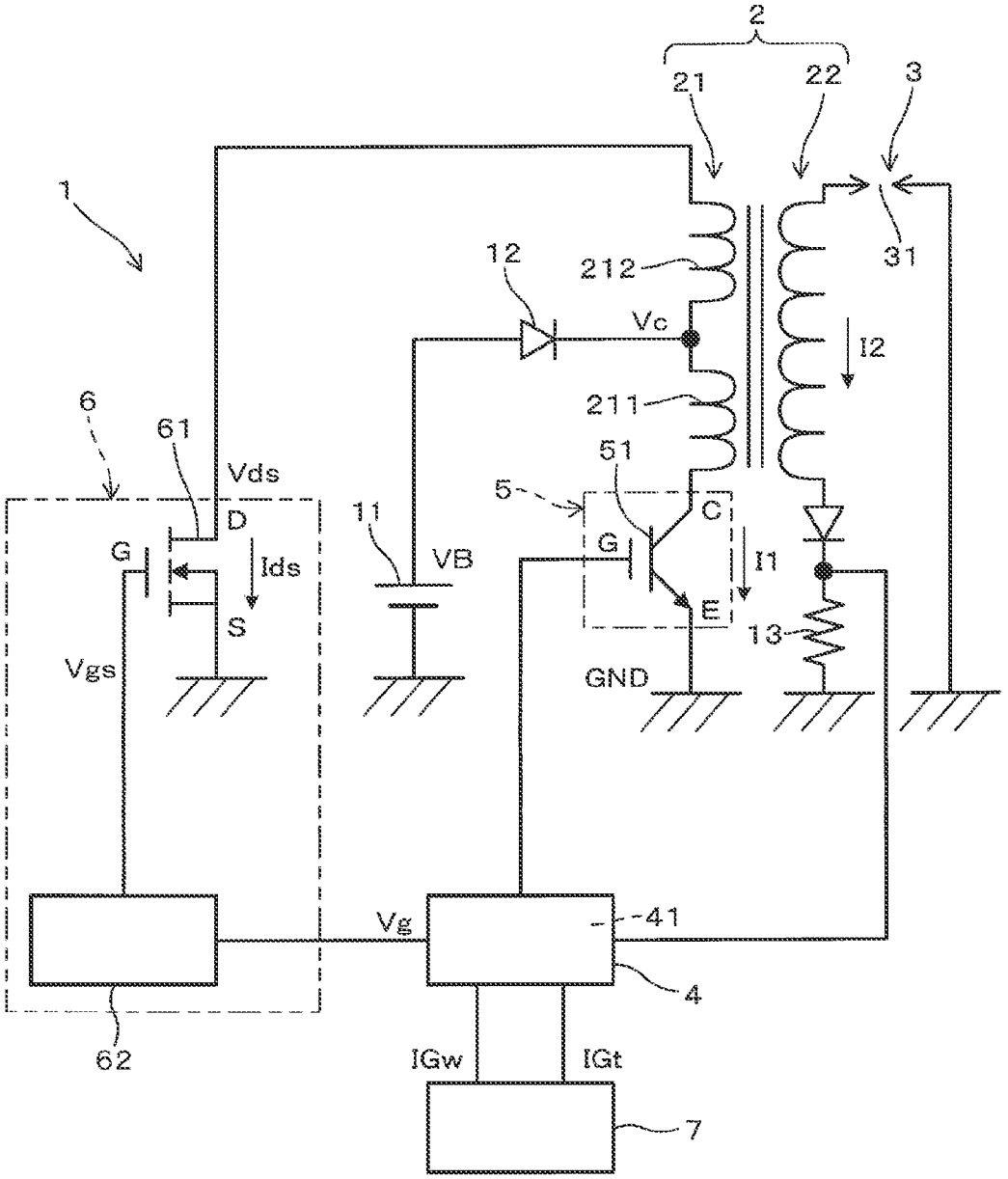
FIG. 1 is a circuit diagram illustrating an internal combustion engine ignition device according to a first embodiment.

For example, in the internal combustion engine ignition device disclosed in WO2017/006487 A, a primary coil includes a main primary coil and a sub primary coil. The main primary coil generates an energization magnetic flux in a positive direction by energization from a DC power source and thereafter generates an interruption magnetic flux in a reverse direction by interruption of energization. The sub primary coil generates an additional magnetic flux in the same direction as that of the interruption magnetic flux by energization from the DC power source.

Then, the energization to the main primary coil is interrupted by a main semiconductor switch to generate a discharge spark in an ignition plug. In a discharge period after this interruption timing, the sub primary coil is energized by a sub semiconductor switch for a predetermined superimposed time to increase the discharge current generated in the secondary coil in a superimposed manner. The sub semiconductor switch repeats energization and interruption of energization to the sub primary coil such that the discharge current is within a range between a predetermined upper limit value and a predetermined lower limit value.

In the internal combustion engine ignition device of WO2017/006487 A, it became clear that a voltage at both ends of the sub primary coil oscillates to a large extent in response to interruption of an energization state to the sub primary coil by the sub semiconductor switch. Furthermore, while the voltage at both ends of the sub primary coil is lower than a current-inputtable voltage by the sub semiconductor switch due to the oscillation, a current cannot be input to the sub primary coil even when the sub semiconductor switch is turned on. In other words, input of a current to the sub primary coil for continuing a discharge current of the secondary coil comes to be delayed until the voltage at both ends of the sub primary coil recovers to equal to or more than a current-inputtable voltage by the sub semiconductor switch.

During a period in which input of a current to the sub primary coil is delayed, the discharge current continues to decrease, which may cause the discharge current to become lower than a desired control lower limit. In order to control the discharge current not to become lower than a desired control lower limit, the control upper limit value of the discharge current needs to be increased. However, increasing the control upper limit value of the discharge current may uselessly consume electric energy.

The present disclosure has been made in view of such a problem and achieved in an attempt to provide an internal combustion engine ignition device that appropriately inputs a current to the primary coil for continuing the discharge current of the secondary coil and suppresses consumption of electric energy.

A first aspect of the present disclosure is an internal combustion engine ignition device including an ignition coil having a primary coil to be applied with a DC voltage by a DC power source and a secondary coil to generate an induced electromotive force in response to interruption of energization to the primary coil, an ignition plug for generating a spark discharge in a combustion chamber of an internal combustion engine by the induced electromotive force, a main ignition circuit having a first switching element that performs energization and interruption of energization to a first coil part, which constitutes at least a portion of the primary coil, for generating the induced electromotive force using the DC voltage, and an energy input circuit having a second switching element that performs energization and interruption of energization to a second coil part, which constitutes at least a portion of the primary coil, for keeping a discharge current in the secondary coil within an intended range directly using the DC voltage after the induced electromotive force has been generated, and a soft-off circuit to slow a turn-off speed of the second switching element.

The energy input circuit is configured to, when decreasing a signal voltage added to a gate of the second switching element, execute a first decreasing stage of decreasing the signal voltage until it reaches the vicinity of a gate-source threshold voltage and a second decreasing stage of gradually decreasing the signal voltage in the vicinity of the threshold voltage.

A second aspect of the present disclosure is an internal combustion engine ignition device including an ignition coil having a primary coil to be applied with a DC voltage by a DC power source and a secondary coil to generate an induced electromotive force in response to interruption of energization to the primary coil, an ignition plug for generating a spark discharge in a combustion chamber of an internal combustion engine by the induced electromotive force, a main ignition circuit having a first switching element that performs energization and interruption of energization to a first coil part, which constitutes at least a portion of the primary coil, for generating the induced electromotive force using the DC voltage, and an energy input circuit having a second switching element that performs energization and interruption of energization to a second coil part, which constitutes at least a portion of the primary coil, for keeping a discharge current in the secondary coil within an intended range directly using the DC voltage after the induced electromotive force has been generated, the energy input circuit being configured to make a turn-off speed of the second switching element slower than a turn-on speed of the second switching element.

The energy input circuit is configured to, when decreasing a signal voltage added to a gate of the second switching element, execute a first decreasing stage of decreasing the signal voltage until it reaches the vicinity of a gate-source threshold voltage and a second decreasing stage of gradually decreasing the signal voltage in the vicinity of the threshold voltage.

A third aspect of the present disclosure is an internal combustion engine ignition device including an ignition coil having a primary coil to be applied with a DC voltage by a DC power source and a secondary coil to generate an induced electromotive force in response to interruption of energization to the primary coil, an ignition plug for generating a spark discharge in a combustion chamber of an internal combustion engine by the induced electromotive force, a main ignition circuit having a first switching element that performs energization and interruption of energization to a first coil part, which constitutes at least a portion of the primary coil, for generating the induced electromotive force using the DC voltage, and an energy input circuit having a second switching element that controls an energization state to a second coil part, which constitutes at least a portion of the primary coil, for keeping a discharge current in the secondary coil at an intended value directly using the DC voltage after the induced electromotive force has been generated, the energy input circuit being configured to maintain a state in which a voltage applied to the second coil part by the second switching element is lower than the DC voltage.

The energy input circuit is configured to gradually increase a gate-source voltage of the second switching element in the vicinity of a threshold voltage thereby to limit and gradually increase a current flowing between the drain and the source of the second switching element, such that the discharge current of the secondary coil is kept at a certain value.

[Internal Combustion Engine Ignition Device of First Aspect]

In the internal combustion engine ignition device of the first aspect, the energy input circuit has a soft-off circuit that slows a turn-off speed of the second switching element. The second switching element performs energization and interruption of energization to the second coil part of the primary coil for keeping the discharge current in the secondary coil within an intended range after the induced electromotive force has been generated in the secondary coil.

When the turn-off speed of the second switching element is slowed by the soft-off circuit, oscillation of a voltage at both ends of the second coil part of the primary coil can be suppressed when energization to the second switching element is interrupted, that is, when the second switching element is turned off. This can prevent a voltage at both ends of the second coil part of the primary coil from becoming lower than a current-inputtable voltage by the second switching element when energization to the second switching element is interrupted.

Therefore, after energization to the second coil part of the primary coil has been interrupted by the second switching element, energization to the second coil part of the primary coil is quickly resumed by the second switching element. As a result, input of a current to the second coil part of the primary coil for continuing the discharge current of the secondary coil is quickly performed. Consequently, the discharge current can be controlled such that it does not become lower than the control lower limit value without increasing the control upper limit value of the discharge current, and consumption of electric energy is prevented from increasing.

Also, energization to the second coil part of the primary coil by the second switching element and the soft-off circuit is performed directly using a DC voltage of the DC power source. Furthermore, a circuit to boost the DC voltage is not used for energizing the second coil part of the primary coil. This suppresses, for example, an increase in size and cost of a device for continuing the discharge current of the secondary coil.

Therefore, according to the internal combustion engine ignition device of the first aspect, input of a current to the primary coil for continuing the discharge current of the secondary coil is adequately performed, and consumption of electric energy is suppressed.

[Internal Combustion Engine Ignition Device of Second Aspect]

In the internal combustion engine ignition device of the second aspect, the energy input circuit is configured to make a turn-off speed of the second switching element slower than a turn-on speed of the second switching element. This configuration enables oscillation of a voltage at both ends of the second coil part of the primary coil to become suppressed when the second switching element is turned off, similarly to the internal combustion engine ignition device of the first aspect. The turn-off speed indicates a speed at which the second switching element is turned from on to off, and the turn-on speed indicates a speed at which the second switching element is turned from off to on.

Therefore, according to the internal combustion engine ignition device of the second aspect, input of a current to the primary coil for continuing the discharge current of the secondary coil is also adequately performed, and consumption of electric energy is suppressed.

[Internal Combustion Engine Ignition Device of Third Aspect]

In the internal combustion engine ignition device of the third aspect, the energy input circuit is configured such that a voltage applied to the second coil part of the primary coil by the second switching element is kept in a state of being lower than the DC voltage of the DC power source. This state can be formed by, for example, forming a state in which the second switching element does not become completely on. This configuration enables oscillation of a voltage at both ends of the second coil part of the primary coil to become suppressed when the energization state of the second switching element is controlled.

Therefore, according to the internal combustion engine ignition device of the third aspect, input of a current to the primary coil for continuing the discharge current of the secondary coil is also adequately performed, and consumption of electric energy is suppressed.

It is noted that although a parenthesized reference sign of each constituent illustrated in the internal combustion engine ignition device of the present disclosure represents a correspondence relation with a reference sign in the drawing in each embodiment, each constituent is not limited to only the contents of each embodiment.

Preferable embodiments of the above-described internal combustion engine ignition device will be described with reference to the drawings.

First Embodiment

Figure 2:
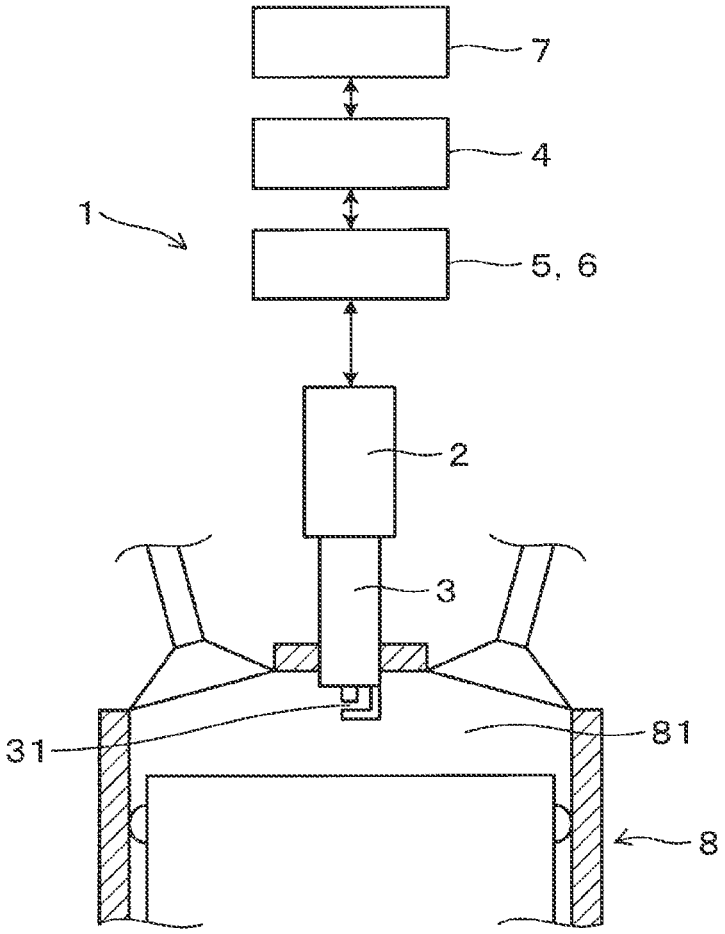
FIG. 2 is a schematic diagram illustrating a peripheral components of an internal combustion engine according to the first embodiment.

An internal combustion engine ignition device 1 of the present embodiment (hereinafter, merely referred to as an ignition device 1 includes, as illustrated in FIG. 1 and FIG. 2, an ignition coil 2, an ignition plug 3, a main ignition circuit 5, and an energy input circuit 6. The ignition coil 2 has a primary coil 21 to be applied with a DC voltage VB by a DC power source 11 and a secondary coil 22 to generate an induced electromotive force in response to interruption of energization to the primary coil 21. The ignition plug 3 generates a spark discharge in a combustion chamber 81 of an internal combustion engine 8 by the induced electromotive force.

Figure 3:
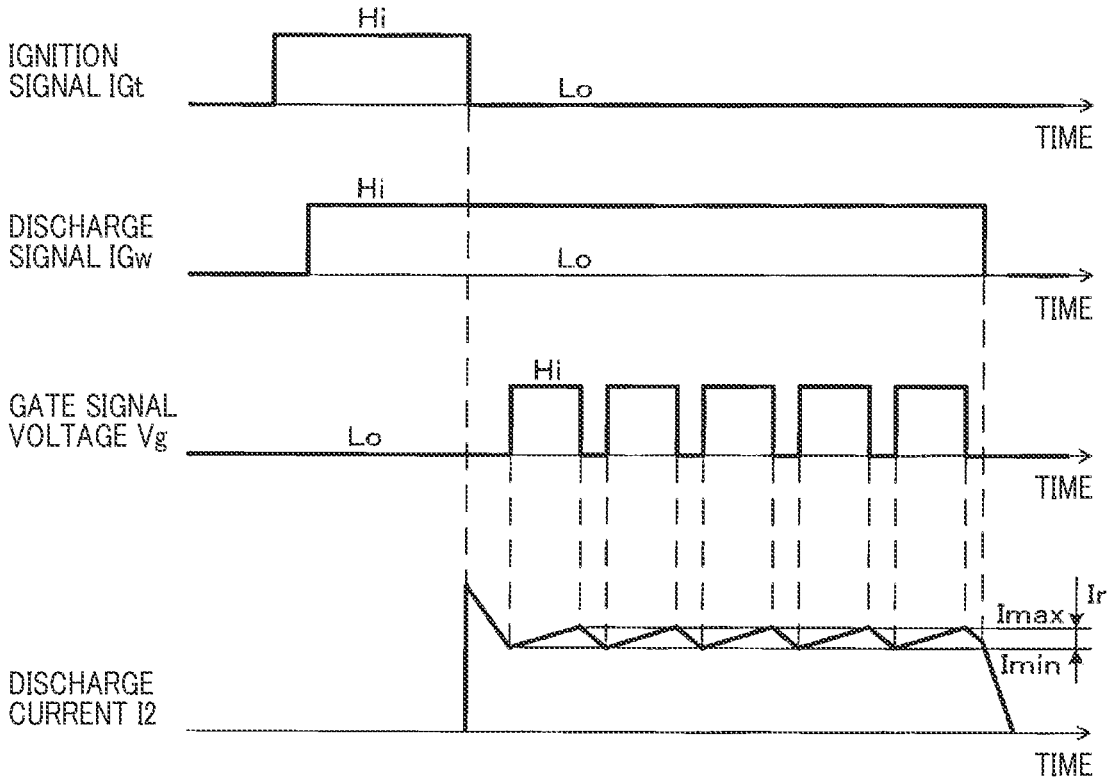
FIG. 3 is a timing chart illustrating an action of the internal combustion engine ignition device in a combustion step of an internal combustion engine according to the first embodiment.

As illustrated in FIG. 1 and FIG. 3, the main ignition circuit 5 has a first switching element 51 that performs energization and interruption of energization to a first coil part 211, which constitutes a portion of the primary coil 21, for generating an induced electromotive force using the DC voltage VB. The energy input circuit 6 has a second switching element 61 and a soft-off circuit 62. The second switching element 61 performs energization and interruption of energization to a second coil part 212, which constitutes another portion of the primary coil 21, for keeping a discharge current I2 in the secondary coil 22 within an intended range Ir directly using the DC voltage VB after the induced electromotive force has been generated. The soft-off circuit 62 is configured to slow a turn-off speed of the second switching element 61.

Hereinafter, the ignition device 1 of the present embodiment will be described in detail.

As illustrated in FIG. 2, the internal combustion engine 8 is an engine having a plurality of cylinders, and the ignition device 1 is used for igniting a fuel-gas mixture in the combustion chamber 81 of each cylinder of an engine in a vehicle.

[Ignition Coil 2]

As illustrated in FIG. 1, the primary coil 21 of the ignition coil 2 has the first coil part 211 and the second coil part 212 that is connected to the first coil part 211 and generates a magnetic flux in the same direction as a magnetic flux generated in response to interruption of energization of the first coil part 211. One end of the first coil part 211 is connected to the DC power source 11 through a diode 12, and the other end of the first coil part 211 is connected to the first switching element 51. One end of the second coil part 212 is connected to the DC power source 11 through the diode 12, and the other end of the first coil part 211 is connected to the second switching element 61. In other words, the DC power source 11 is connected to a position between the first coil part 211 and the second coil part 212 through the diode 12. The DC power source 11 is a power source mounted on a vehicle and constituted by a battery of 12 V, 24 V, or the like, a power source circuit, or others.

The secondary coil 22 of the ignition coil 2 is formed by winding a wire thinner than a wire constituting the primary coil 21 with the number of turns larger than the number of turns of the wire constituting the primary coil 21. The secondary coil 22 is disposed concentrically to the primary coil 21. In response to interruption of energization to the first coil part 211 of the primary coil 21, an induced electromotive force is generated in the secondary coil 22 such that a change in magnetic flux in the first coil part 211 can be prevented by mutual induction effects.

[Ignition Plug 3]

As illustrated in FIG. 1 and FIG. 2, the ignition plug 3 is connected to the secondary coil 22 in the ignition coil 2 and generates a spark discharge by the discharge current I2 generated in the secondary coil 22. The ignition plug 3 has a center electrode connected to the secondary coil 22 and an earth electrode connected to a ground GND. A discharge gap 31 between the center electrode and the earth electrode is disposed in the combustion chamber 81 of each cylinder. While the discharge current I2 flows through the secondary coil 22, a spark discharge is generated at the discharge gap 31 in the ignition plug 3.

The ignition device 1 of the present embodiment does not have, for example, a booster circuit to boost the DC voltage VB of the DC power source 11. Furthermore, as previously described, one end of the second coil part 212 of the primary coil 21 is directly connected to the DC voltage VB of the DC power source 11 through the diode 12. The first coil part 211 and the second coil part 212 of the primary coil 21 are configured such that the DC voltage VB of the DC power source 11 is directly used for a current to flow.

[Ignition Control Circuit 4, Main Ignition Circuit 5, Energy Input Circuit 6, and Electronic Control Unit 7]

As illustrated in FIG. 1, the main ignition circuit 5 and the energy input circuit 6 are activated by an ignition control circuit 4 that receives a control command from an electronic control unit (ECU) 7 constituted by a computer. The electronic control unit 7 is connected to the ignition control circuit 4 that performs ignition control of each cylinder of an engine, and the main ignition circuit 5 and the energy input circuit 6 are connected to the ignition control circuit 4. An ignition signal IGt and a discharge signal IGw, which are a control command by the electronic control unit 7, are transmitted to the ignition control circuit 4. The ignition control circuit 4 also includes a current detection circuit part 41 that detects the discharge current I2 flowing through the secondary coil 22. The current detection circuit part 41 detects a voltage generated in a resistor 13 for detecting the discharge current I2.

In response to reception of the ignition signal IGt and the discharge signal IGw, which are a control command from the electronic control unit 7, the ignition control circuit 4 outputs a gate voltage (gate-emitter voltage) to the first switching element 51 of the main ignition circuit 5 and a gate signal voltage Vg to the second switching element 61 of the energy input circuit 6. Also, the ignition control circuit 4 compares the discharge current I2 detected by the current detection circuit part 41 to a control upper limit value Imax and a control lower limit value Imin of discharge current maintenance control to generate the gate signal voltage Vg and outputs the generated gate signal voltage Vg to the energy input circuit 6.

As illustrated in FIG. 1, the main ignition circuit 5 is configured to perform energization control to the first coil part 211 of the primary coil 21 and may have an element other than the first switching element 51, an electronic component, and others. The first switching element 51 of the main ignition circuit 5 is constituted by an IGBT (insulated-gate bipolar transistor) or others. A gate G of the first switching element 51 is connected with the ignition control circuit 4, and a collector C of the first switching element 51 is connected with one end of the first coil part 211. Also, an emitter E of the first switching element 51 is connected to the ground GND.

The energy input circuit 6 is configured to perform energization control to the second coil part 212 of the primary coil 21 and may have an element other than the second switching element 61, an electronic component, and others. The second switching element 61 of the energy input circuit 6 is constituted by a MOSFET (MOS type field effect transistor) or others. A gate G of the second switching element 61 is connected with the ignition control circuit 4 through the soft-off circuit 62, and a drain D of the second switching element 61 is connected with one end of the second coil part 212. Also, a source S of the second switching element 61 is connected to the ground GND. It is noted that the soft-off circuit 62 may be contained in the ignition control circuit 4.

The ignition control circuit 4 controls the gate signal voltage Vg transmitted to the second switching element 61 of the energy input circuit 6, such that the discharge current I2 flowing through the secondary coil 22 is kept within the intended range Ir between the control upper limit value Imax and the control lower limit value Imin, after a spark discharge has been generated in the secondary coil 22. The ignition control circuit 4 changes the gate signal voltage Vg between Hi (High) and Lo (Low), such that the discharge current I2 detected by the current detection circuit part 41 is kept within the intended range Ir.

[Soft-Off Circuit 62]

As illustrated in FIG. 1, the soft-off circuit 62 constitutes a portion of the energy input circuit 6 and is disposed between the ignition control circuit 4 and the second switching element 61. The soft-off circuit 62 slowly decreases a gate voltage (gate-source voltage) Vgs as a signal voltage added to the gate G, when the second switching element 61 is turned off, thereby to slow the turn-off speed when the second switching element 61 is turned from on to off.

Figure 4:
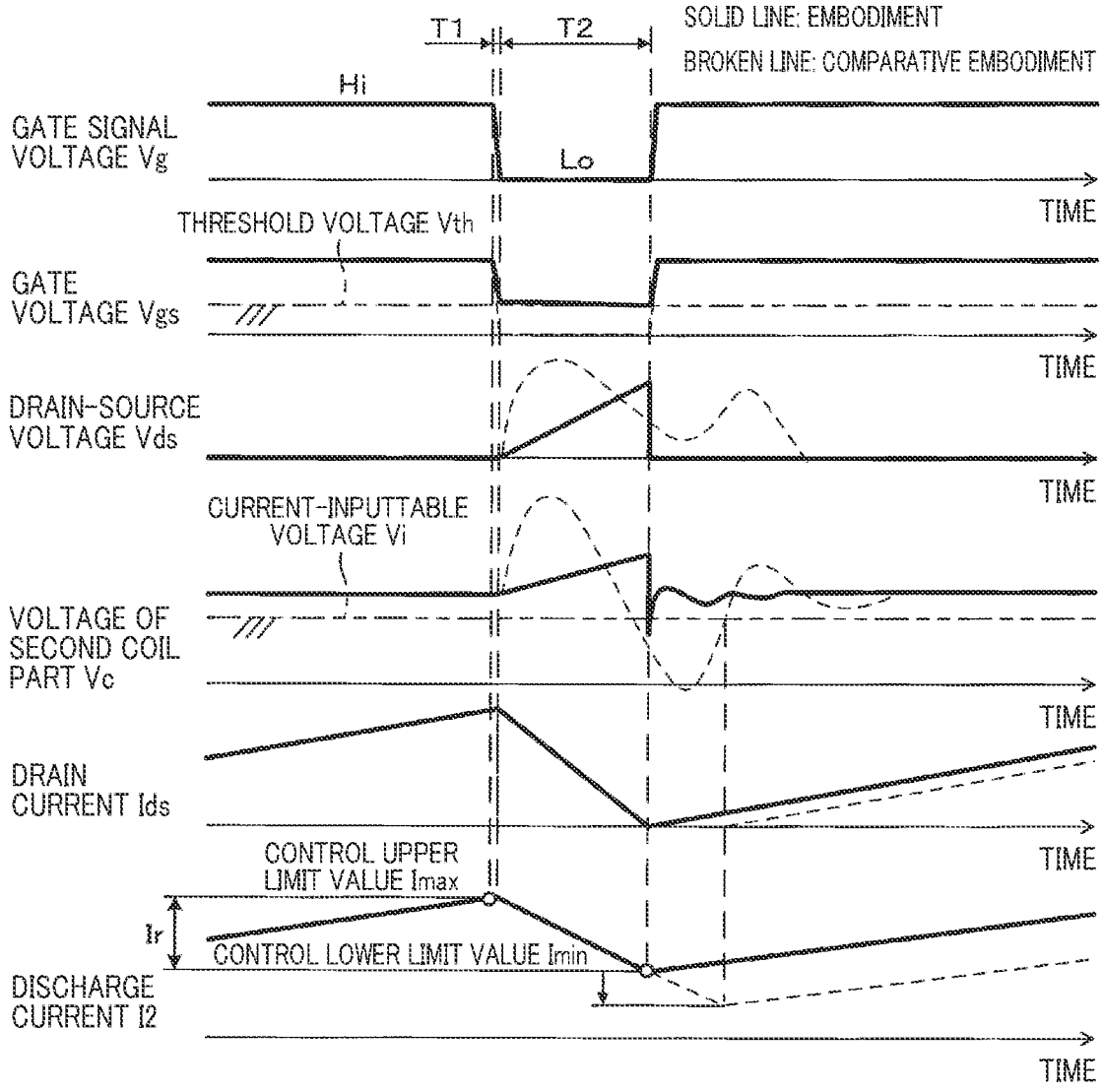
FIG. 4 is a timing chart illustrating an action of maintaining a discharge current of a secondary coil using a second switching element of an energy input circuit according to the first embodiment.

As illustrated in FIG. 4, the soft-off circuit 62 is configured to, when decreasing the gate voltage Vgs added to the gate G of the second switching element 61, execute a first decreasing stage T1 of decreasing the gate voltage Vgs until it reaches the vicinity of a gate-source threshold voltage Vth and a second decreasing stage T2 of gradually decreasing the gate voltage Vgs in the vicinity of the threshold voltage Vth. In other words, the decreasing speed of the gate voltage Vgs in the second decreasing stage T2 is made slower than the decreasing speed of the gate voltage Vgs in the first decreasing stage T1. The threshold voltage Vth indicates a voltage at a boundary where the second switching element 61 is switched between on and off. The first decreasing stage T1 allows the gate voltage Vgs to quickly decrease until it reaches the vicinity of the threshold voltage Vth to ensure the turn-off speed of the second switching element 61. Also, the second decreasing stage T2 allows the gate voltage Vgs to gradually decrease thereby to slowly increase a voltage Vc at both ends of the second coil part 212 of the primary coil 21 when the second switching element 61 is turned off, so that the oscillation of this voltage Vc can be suppressed.

It is noted that the soft-off circuit 62 may decrease the gate voltage Vgs added to the gate G of the second switching element 61 in three or more stages. Also, the soft-off circuit 62 may decrease the gate voltage Vgs added to the gate G of the second switching element 61 steplessly and curvilinearly.

Figure 5:
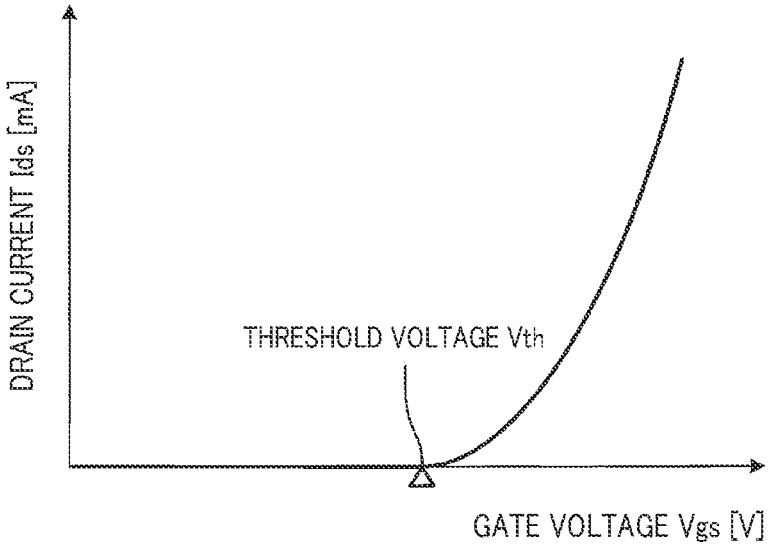
FIG. 5 is a graph illustrating a relationship between a gate voltage (gate-source voltage) and a drain current (drain-source current) according to the first embodiment.

As illustrated in FIG. 5, in a MOSFET constituting the second switching element 61, a drain current (drain-source current) Ids starts flowing when the gate voltage (gate-source voltage) Vgs reaches equal to or more than the threshold voltage Vth as a predetermined voltage. In a region where the gate voltage Vgs is equal to or more than the threshold voltage Vth, enhancement properties are exhibited in which as the gate voltage Vgs increases, the drain current Ids increases. It is noted that the threshold voltage Vth is, for example, about 3 V.

As illustrated in FIG. 4, in the first decreasing stage T1 of the present embodiment, the gate voltage Vgs added to the gate G of the second switching element 61 is decreased to a voltage that is somewhat higher than the threshold voltage Vth. Subsequently, in the second decreasing stage T2 of the present embodiment, the gate voltage Vgs is decreased from a voltage that is somewhat higher than the threshold voltage Vth to the threshold voltage Vth, such that the voltage Vc at both ends of the second coil part 212 of the primary coil 21 gradually increases.

The soft-off circuit 62 is configured to change the gate voltage Vgs added to the gate G of the second switching element 61 of the energy input circuit 6 between Hi voltage and the threshold voltage Vth. While the second switching element 61 is off, the soft-off circuit 62 activates the second switching element 61 in the vicinity of the threshold voltage Vth to form a state in which a minute drain current Ids flows between the drain and the source of the second switching element 61. This gradually increases the voltage Vc at both ends of the second coil part 212 of the primary coil 21.

It is noted that the gate voltage Vgs is not necessarily decreased to the threshold voltage Vth during turn-off of the second switching element 61. That is, the gate voltage Vgs may be slowly decreased while maintaining a voltage that is higher than the threshold voltage Vth, during turn-off of the second switching element 61. As illustrated in FIG. 5, as the gate voltage Vgs decreases, the drain current Ids decreases. Therefore, the voltage Vc at both ends of the second coil part 212 of the primary coil 21 can also be made not to become lower than a current-inputtable voltage Vi by decreasing the gate voltage Vgs to a voltage higher than the threshold voltage Vth for squeezing the drain current Ids.

Also, since a MOSFET has a parasitic capacitance, the drain current Ids sometimes flows even when the gate voltage Vgs is decreased to a voltage that is somewhat lower than the threshold voltage Vth during turn-off of the second switching element 61, which somewhat increases the gate voltage Vgs. Therefore, in the first decreasing stage T1, there is some case where the gate voltage Vgs may be decreased to a voltage that is about the same voltage as the threshold voltage Vth or to a voltage that is somewhat lower than the threshold voltage Vth.

The ignition device 1 of the present embodiment is configured such that the gate voltage Vgs becomes around the threshold voltage Vth when the second switching element 61 is turned off. Therefore, the voltage Vc added to the second coil part 212 by the second switching element 61, i.e., the voltage Vc at both ends of the second coil part 212, is kept in a state of being lower than the DC voltage VB of the DC power source 11.

[Action of Ignition Device 1]

Figure 6:
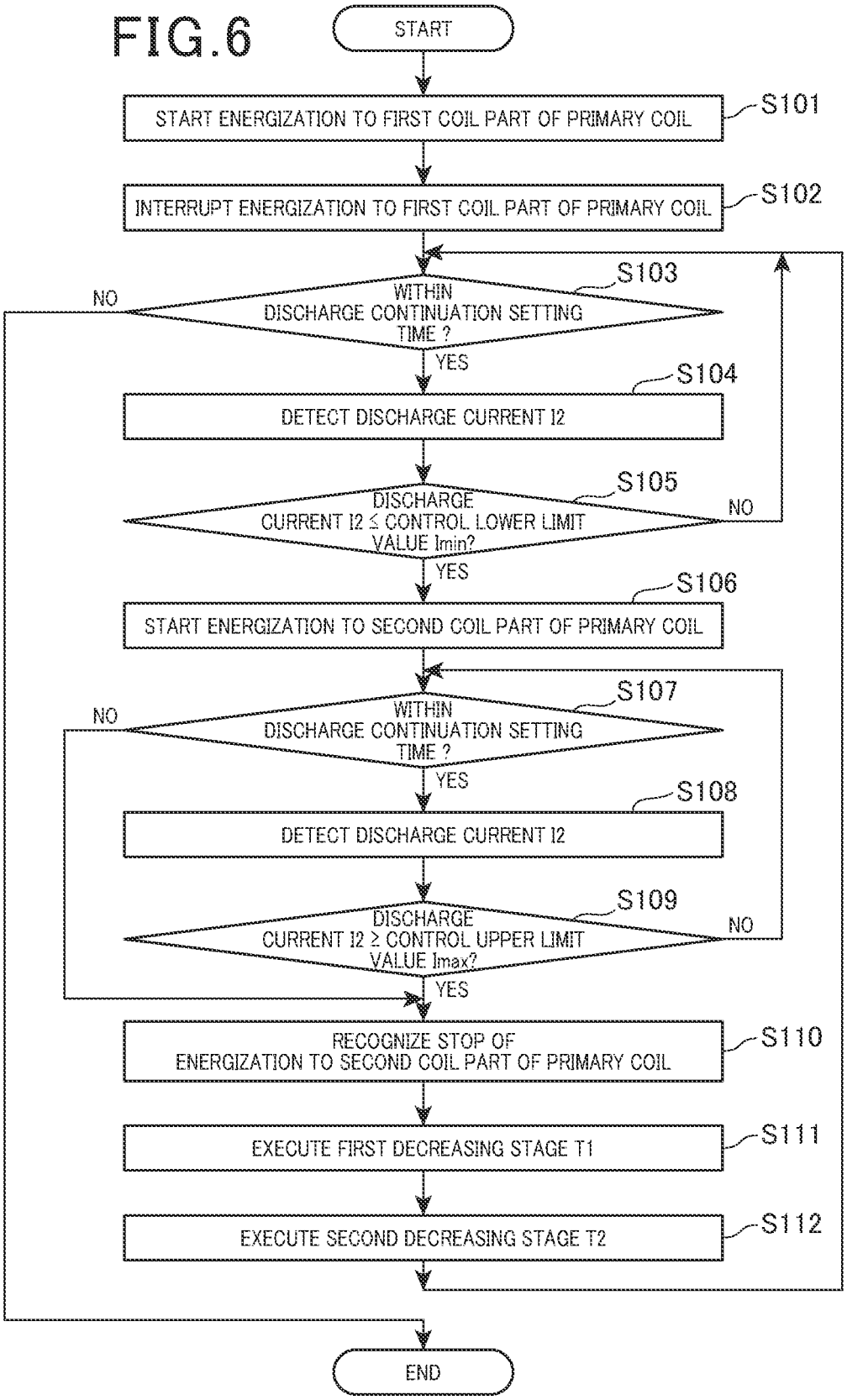
FIG. 6 is a flowchart illustrating an action of an internal combustion engine ignition device according to the first embodiment.

Hereinafter, an action of the ignition device 1 will be described with reference to the timing charts of FIG. 3 and FIG. 4 and the flowchart of FIG. 6. In the timing chart of FIG. 4, waveforms of a voltage and a current when the energy input circuit 6 has the soft-off circuit 62 are illustrated with solid lines.

In each cylinder of an engine, a fuel-gas mixture is ignited by the ignition device 1 in the combustion step when a combustion cycle is repeated. For generating a spark discharge in the combustion step, the first switching element 51 of the main ignition circuit 5 is turned on in response to reception of the ignition signal IGt by the electronic control unit 7 and the ignition control circuit 4, and the first coil part 211 of the primary coil 21 is energized, as illustrated in FIG. 3 (step S101 in FIG. 6). Then, as illustrated in FIG. 3, when the energization to the first coil part 211 is interrupted in response to turn-off of the first switching element 51, mutual induction effects are exerted so that a high voltage proportional to how much the number of turns of the wire of the secondary coil 22 is relative to the number of turns of the wire of the first coil part 211 is generated in the secondary coil 22, and the discharge current I2 is generated (step S102). At this time, a spark discharge is generated at the discharge gap 31 of the ignition plug 3.

FIG. 3 illustrates a state in which the discharge current I2 of the secondary coil 22 repeatedly increases and decreases between the control upper limit value Imax and the control lower limit value Imin, in response to energization and interruption of energization to the second coil part 212 of the primary coil 21 by the gate signal voltage Vg.

It is noted that the discharge control of the secondary coil 22 ends after a lapse of a discharge continuation setting time represented by a time period during which the discharge signal IGw is Hi (step S103), regardless of the magnitude of the discharge current I2.

Subsequently, the discharge current I2 generated in the secondary coil 22 is detected by the current detection circuit part 41 and the ignition control circuit 4 (step S104). Then, whether the discharge current I2 has become the control lower limit value Imin or less is detected (step S105). As illustrated in FIG. 4, in response to the discharge current I2 becoming the control lower limit value Imin or less, the second switching element 61 of the energy input circuit 6 is turned on in response to receipt of the gate signal voltage Vg by the ignition control circuit 4, and energization to the second coil part 212 of the primary coil 21 starts (step S106). Accordingly, a current I1 flows through the second coil part 212, and this current I1 increases. Also, mutual induction effects are exerted to increase the discharge current I2 flowing through the secondary coil 22.

Subsequently, the discharge current I2 generated in the secondary coil 22 is detected again by the current detection circuit part 41 and the ignition control circuit 4 (step S108). Then, whether the discharge current I2 has become the control upper limit value Imax or more is detected (step S109). In response to the discharge current I2 becoming the control upper limit value Imax or more, the ignition control circuit 4 recognizes that the energization to the second coil part 212 of the primary coil 21 needs to stop (step S110). It is noted that after a lapse of the discharge continuation setting time (step S107), step S110 is executed without executing step S108 and S109.

When step S110 is executed, the soft-off circuit 62 of the energy input circuit 6 decreases the gate voltage Vgs added to the gate G of the second switching element 61 to a voltage that is somewhat higher than the gate-source threshold voltage Vth, as the first decreasing stage T1, as illustrated in FIG. 4 (step S111). This decrease of the gate voltage Vgs in the first decreasing stage T1 is performed rapidly. Subsequently, the soft-off circuit 62 decreases the gate voltage Vgs added to the gate G of the second switching element 61 to the gate-source threshold voltage Vth, as the second decreasing stage T2 (step S112). This decrease of the gate voltage Vgs in the second decreasing stage T2 is performed slowly such that the voltage Vc at both ends of the second coil part 212 gradually increases.

Then, as illustrated in FIG. 4, the drain current Ids of the second switching element 61 decreases, while the discharge current I2 of the secondary coil 22 decreases. At this time, the gate voltage Vgs added to the gate G of the second switching element 61 slowly decreases in the second decreasing stage T2, so that a drain-source voltage Vds of the second switching element 61 and the voltage Vc at both ends of the second coil part 212 slowly increase. Accordingly, the voltage Vc at both ends of the second coil part 212 can be prevented from oscillating.

Subsequently, when the discharge continuation setting time has not lapsed (step S103), the discharge current I2 generated in the secondary coil 22 is detected again by the current detection circuit part 41 and the ignition control circuit 4 (step S104). Then, whether the discharge current I2 has become the control lower limit value Imin or less is detected (step S105). In response to the discharge current I2 becoming the control lower limit value Imin or less, the second switching element 61 is turned on again in response to receipt of the gate signal voltage Vg by the ignition control circuit 4, and energization to the second coil part 212 of the primary coil 21 starts again (step S106).

At this time, the voltage Vc at both ends of the second coil part 212 does not become lower than the current-inputtable voltage Vi, or a time period during which the voltage Vc is lower than the current-inputtable voltage Vi is short. Therefore, energization to the second coil part 212 immediately starts, and the drain current Ids of the second switching element 61 immediately starts increasing. This can prevent the timing of inputting a current to the second coil part 212 from delaying at turn-on when energization of the second switching element 61 starts.

The current-inputtable voltage Vi is set based on a phenomenon in which in an attempt to allow a current to flow through the second coil part 212 by the second switching element 61, a current does not flow through the second coil part 212 when the voltage Vc at both ends of the second coil part 212 is lower than a certain value. The current-inputtable voltage Vi is set as a voltage value which allows a current to flow through the second coil part 212.

Thereafter, steps S103 to S112 are repeated, and discharge control of the secondary coil 22 ends when the discharge continuation setting time has lapsed (step S103). Then, in response to reception of the gate signal voltage Vg by the ignition control circuit 4, a state in which the second switching element 61 is off is continued. It is noted that steps S101 to S112 are repeatedly executed every time the combustion step is performed in each cylinder of an engine.

[Timing Chart of Comparative Embodiment]

In the timing chart of FIG. 4, waveforms of a voltage and a current for a comparative embodiment in which the energy input circuit 6 does not have the soft-off circuit 62 are illustrated with broken lines. In this case, in response to the discharge current I2 of the secondary coil 22 becoming the control upper limit value Imax or more, the second switching element 61 is turned off, and the gate voltage Vgs added to the gate G of the second switching element 61 rapidly decreases until it reaches around 0 V. At this time, the drain current Ids of the second switching element 61 rapidly disappears, and the drain-source voltage Vds of the second switching element 61 and the voltage Vc at both ends of the second coil part 212 oscillate to a large extent.

Especially, when the voltage Vc at both ends of the second coil part 212 decreases lower than the current-inputtable voltage Vi due to an undershoot of an oscillation of the voltage Vc, the drain current Ids of the second switching element 61 does not immediately increase in response to turn-off of the second switching element 61, even when a voltage added to the gate G of the second switching element 61 increases again. This causes the timing of inputting the current I1 to the second coil part 212 to be delayed. As a result, input of electric energy to the discharge current I2 of the secondary coil 22 is delayed, and the fluctuation range of the discharge current I2 of the secondary coil 22 increases.

[Operation Effect]

In the ignition device 1 of the present embodiment, the energy input circuit 6 has the soft-off circuit 62 that slows the turn-off speed of the second switching element 61. The second switching element 61 performs energization and interruption of energization to the second coil part 212 of the primary coil 21 for keeping the discharge current I2 in the secondary coil 22 within the intended range Ir directly using the DC voltage VB, after the induced electromotive force has been generated in the secondary coil 22.

When the turn-off speed of the second switching element 61 is slowed by the soft-off circuit 62, oscillation of the voltage Vc at both ends of the second coil part 212 of the primary coil 21 can be suppressed in response to interruption of energization to the second switching element 61, that is, in response to turn-off of the second switching element 61. This can prevent the voltage Vc at both ends of the second coil part 212 of the primary coil 21 from becoming lower than the current-inputtable voltage Vi by the second switching element 61, when energization to the second switching element 61 is interrupted.

Therefore, after energization to the second coil part 212 of the primary coil 21 has been interrupted by the second switching element 61, energization to the second coil part 212 of the primary coil 21 is quickly resumed by the second switching element 61. As a result, input of the current I1 to the second coil part 212 of the primary coil 21 for continuing the discharge current I2 of the secondary coil 22 is quickly performed. Accordingly, the discharge current I2 can be controlled such that it does not become lower than the control lower limit value Imin without increasing the control upper limit value Imax of the discharge current I2, and the increase of electric energy consumption is suppressed. In other words, the intended range (control width) Ir of the discharge current I2 can be decreased, and consumption of electric energy is reduced.

Also, in the present embodiment, energization to the second coil part 212 of the primary coil 21 by the second switching element 61 and the soft-off circuit 62 is performed directly using the DC voltage VB of the DC power source 11. A circuit to boost the DC voltage VB is not used for energizing the second coil part 212 of the primary coil 21. Also, since the oscillation of the voltage Vc at both ends of the second coil part 212 of the primary coil 21 can be suppressed by using the soft-off circuit 62, there is no need to use a large-sized condenser between the end of the second coil part 212 and the ground GND. Since the need for the booster circuit and the large-sized condenser is eliminated, the increase in size and cost of the ignition device 1 is suppressed.

It is noted that a small-sized condenser may be connected between the end of the second coil part 212 and the ground GND. The condenser in this case may be small in size, because suppression of the oscillation of the voltage Vc at both ends of the second coil part 212 is not intended. On the other hand, as illustrated in the present embodiment, when the gate voltage Vgs is decreased through a plurality of decreasing stages T1 and T2 at turn-off of the second switching element 61, energization to the second coil part 212 may be performed by boosting the DC voltage VB of the DC power source 11 in some cases.

Therefore, according to the ignition device 1 of the present embodiment, input of a current to the primary coil 21 for continuing the discharge current I2 of the secondary coil 22 is adequately performed, and the consumption of electric energy and the increase in size of the ignition device 1 are suppressed.

Second Embodiment

Figure 7:
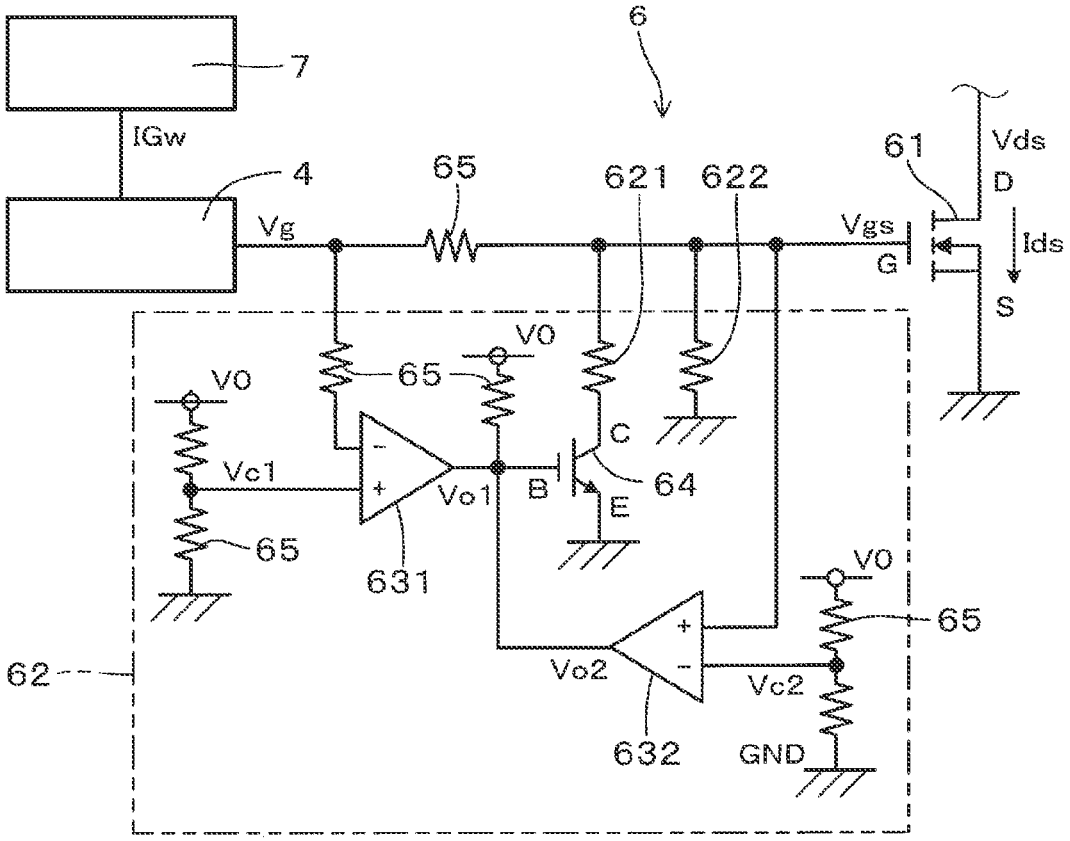
FIG. 7 is a circuit diagram illustrating a configuration of a soft-off circuit of an energy input circuit according to a second embodiment.

In the ignition device 1 of the present embodiment, a specific configuration of the soft-off circuit 62 of the energy input circuit 6 will be illustrated. As illustrated in FIG. 7, the soft-off circuit 62 is configured using a plurality of comparators 631 and 632 by an operational amplifier, a transistor 64, a plurality of resistors 65, and others. The soft-off circuit 62 has two types of control resistors 621 and 622 having different resistance values connected to the gate G of the second switching element 61 such that a current is allowed to flow from the gate G to the ground GND.

Figure 8:
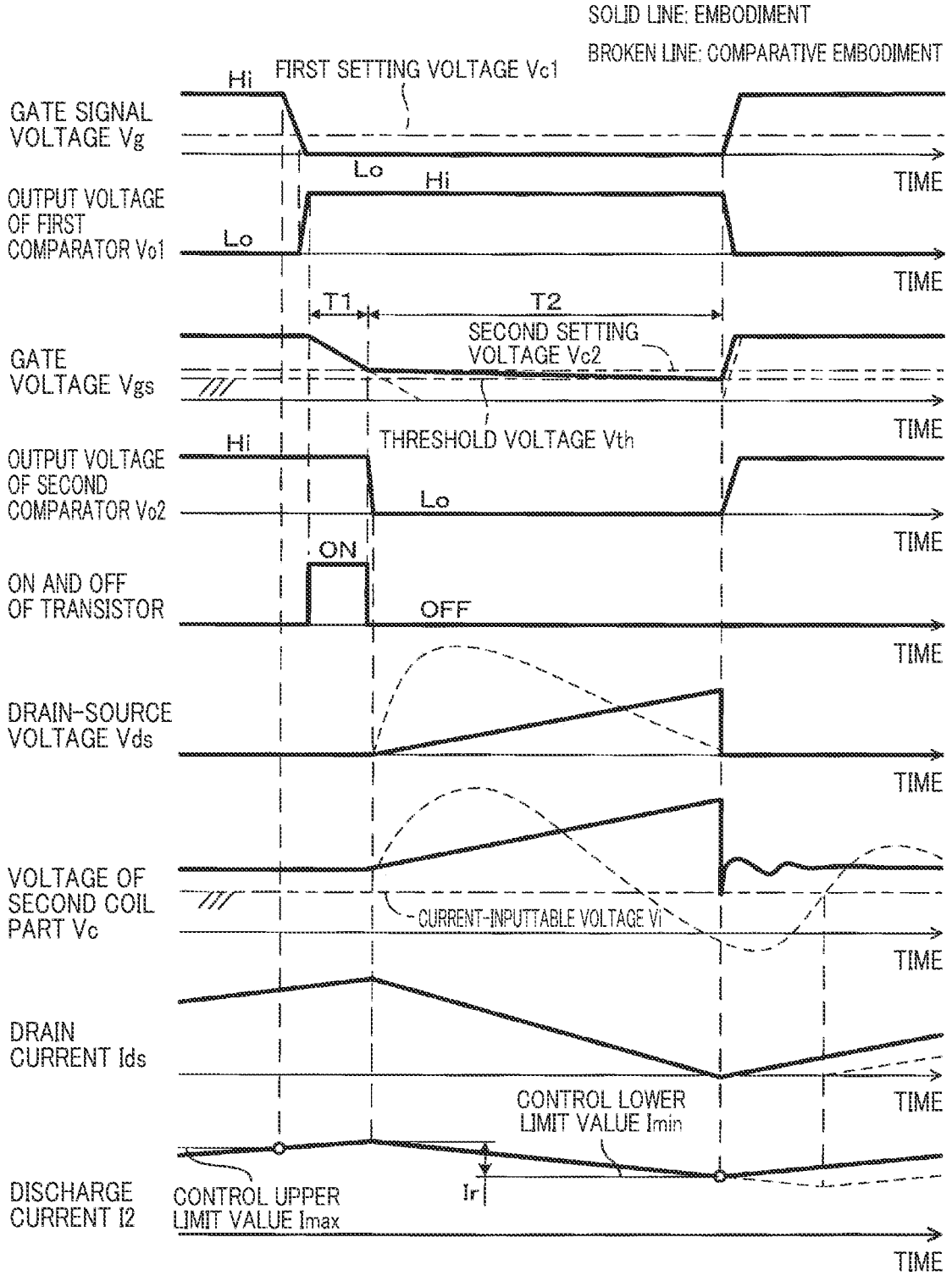
FIG. 8 is a timing chart illustrating an action of maintaining a discharge current of a secondary coil using a second switching element of an energy input circuit according to the second embodiment.

As illustrated in FIG. 8, the soft-off circuit 62 executes, similarly to in the first embodiment, a first decreasing stage T1 of decreasing the gate voltage Vgs added to the gate G of the second switching element 61 until it becomes a voltage that is somewhat higher than the gate-source threshold voltage Vth and a second decreasing stage T2 of decreasing the gate voltage Vgs until it reaches the threshold voltage Vth. In the first decreasing stage T1 of the present embodiment, the gate voltage Vgs added to the gate G of the second switching element 61 is decreased by using the first control resistor 621 having a lower resistance value among two types of control resistors 621 and 622. Since the resistance value of the first control resistor 621 is low, the speed of a current flowing through the first control resistor 621 can be relatively increased to form the first decreasing stage T1.

Also, in the second decreasing stage T2 of the present embodiment, the gate voltage Vgs added to the gate G of the second switching element 61 is decreased by using the second control resistor 622 having a higher resistance value among two types of control resistors 621 and 622. Since the resistance value of the second control resistor 622 is high, the speed of a current flowing through the second control resistor 622 can be slowed to form the second decreasing stage T2.

Also, as illustrated in FIG. 7, the first control resistor 621 of the present embodiment is connected between the collector C of the transistor 64 and the gate G of the second switching element 61 and is switchable between when a current flows and when it does not flow by on and off of the transistor 64. The first control resistor 621 may be connected between the emitter E of the transistor 64 and the ground GND. On the other hand, the second control resistor 622 of the present embodiment is connected between the gate G of the second switching element 61 and the ground GND and discharges a minute current from the gate G to the ground GND, regardless of on or off of the second switching element 61.

The first control resistor 621 and the second control resistor 622 are connected in parallel. In the first decreasing stage T1, electrical charges at the gate G of the second switching element 61 rapidly decrease by the first control resistor 621 and the second control resistor 622. Also, in the second decreasing stage T2, electrical charges at the gate G of the second switching element 61 slowly decrease by the second control resistor 622.

As illustrated in FIG. 7, the soft-off circuit 62 has, other than two types of control resistors 621 and 622, the first comparator 631, the second comparator 632, the transistor 64, and others. The first comparator 631 is configured such that when the gate voltage Vgs added from the ignition control circuit 4 to the gate G of the second switching element 61 is higher than a predetermined first setting voltage Vc1 formed by the resistor 65, Lo (Low) voltage is output to keep the transistor 64 OFF. Also, the first comparator 631 is configured such that in response to the gate voltage Vgs added from the ignition control circuit 4 to the gate G of the second switching element 61 becoming lower than the first setting voltage Vc1, Lo voltage is changed to Hi (High) voltage so that the transistor 64 is turned ON.

The output terminal of the first comparator 631, the output terminal of the second comparator 632, and a base terminal B of the transistor 64 are connected to one another, and this connection point is applied with a circuit voltage V0 for performing an on and off action of the transistor 64 through the resistor 65. The circuit voltage V0 may be the same as the DC voltage VB of the DC power source 11 or may be a predetermined DC voltage that is lower than the DC voltage VB of the DC power source 11.

As illustrated in FIG. 7, the second comparator 632 is configured such that when the gate voltage Vgs added from the ignition control circuit 4 to the gate G of the second switching element 61 is higher than a predetermined second setting voltage Vc2 formed by the resistor 65, Hi voltage is output. Also, the second comparator 632 is configured such that in response to the gate voltage Vgs added from the ignition control circuit 4 to the gate G of the second switching element 61 becoming lower than the second setting voltage Vc2, Hi voltage is changed to Lo voltage so that the transistor 64 is turned OFF.

A voltage value that is higher than the gate-source threshold voltage Vth of the second switching element 61 and the second setting voltage Vc2 of the second comparator 632 is set to the first setting voltage Vc1 of the first comparator 631. A voltage value that is higher than the gate-source threshold voltage Vth of the second switching element 61 is set to the second setting voltage Vc2. A voltage value that is higher by 0.2 to 1 V than the threshold voltage Vth, for example, can be set to the second setting voltage Vc2.

[Action of Ignition Device 1]

Hereinafter, an action of the ignition device 1 will be described with reference to the timing chart of FIG. 8. In the timing chart of FIG. 8, waveforms of a voltage and a current when the energy input circuit 6 has the soft-off circuit 62 are illustrated with solid lines.

In the ignition device 1 of the present embodiment, the current I1 is allowed to intermittently flow though the second coil part 212 of the primary coil 21, such that the discharge current I2 is kept within the intended range Ir after the discharge current I2 has been generated in the secondary coil 22. The timing chart of FIG. 8 illustrates changes in voltage and current of each component of the ignition device 1 during a process in which the gate signal voltage Vg from the ignition control circuit 4 changes in the following order: Hi voltage (merely indicated as Hi), Lo voltage (merely indicated as Lo), and Hi voltage.

In FIG. 7 and FIG. 8, when the gate signal voltage Vg of the ignition control circuit 4 is Hi, the gate voltage (gate-source voltage) Vgs of the second switching element 61 is Hi. At this time, the output voltage of the first comparator 631 is Lo, the output voltage of the second comparator 632 is Hi, and the transistor 64 is OFF. Also, at this time, the drain-source voltage Vds of the second switching element 61 and the voltage Vc at the high-voltage-side terminal of the second coil part 212 are low. Also, at this time, as illustrated in FIG. 8, the drain current (drain-source current, current of the second coil part 212) Ids of the second switching element 61 and the discharge current I2 of the secondary coil 22 slowly increase.

Subsequently, as illustrated in FIG. 7 and FIG. 8, in response to the discharge current I2 of the secondary coil 22 becoming the control upper limit value Imax or more, the gate signal voltage Vg of the ignition control circuit 4 changes from Hi to Lo. When the gate signal voltage Vg becomes lower than the first setting voltage Vc1 of the first comparator 631 during a process in which the gate signal voltage Vg changes from Hi to Lo, the output voltage of the first comparator 631 changes from Lo to Hi. Then, in response to the output voltage of the first comparator 631 becoming Hi, the transistor 64 is turned from OFF to ON, and electrical charges at the gate G of the second switching element 61 are discharged to the first control resistor 621 by the transistor 64. Accordingly, the gate voltage Vgs of the second switching element 61 starts decreasing.

Subsequently, as illustrated in FIG. 7 and FIG. 8, in response to the gate voltage Vgs of the second switching element 61 becoming lower than the second setting voltage Vc2 of the second comparator 632, the output voltage of the second comparator 632 changes from Hi to Lo, while the transistor 64 is turned from ON to OFF. At this time, electrical charges at the gate G of the second switching element 61 are not discharged to the first control resistor 621 anymore, and minor amounts of electrical charges at the gate G are discharged to the second control resistor 622.

Then, as illustrated in FIG. 8, due to the fact that electric charges at the gate G of the second switching element 61 are slowly discharged, the drain-source voltage Vds of the second switching element 61 starts slowly increasing, while the voltage Vc at the high-voltage-side terminal of the second coil part 212 starts slowly increasing. Accordingly, the drain-source voltage Vds of the second switching element 61 and the voltage Vc at the high-voltage-side terminal of the second coil part 212 are prevented from oscillating. Also, at this time, the drain current (current of the second coil part 212) Ids of the second switching element 61 and the discharge current I2 of the secondary coil 22 start slowly decreasing.

Subsequently, as illustrated in FIG. 7 and FIG. 8, in response to the discharge current I2 of the secondary coil 22 becoming the control lower limit value Imin or less, the gate signal voltage Vg of the ignition control circuit 4 changes from Lo to Hi. At this time, the output voltage of the first comparator 631 changes from Hi to Lo, while the output voltage of the second comparator 632 changes from Lo to Hi, and the gate voltage Vgs of the second switching element 61 changes from around the threshold voltage Vth to Hi. Also, at this time, the drain-source voltage Vds of the second switching element 61 and the voltage Vc at the high-voltage-side terminal of the second coil part 212 change from the highest state to the lowest state.

In FIG. 8, the voltage Vc at the high-voltage-side terminal of the second coil part 212 decreases to a voltage in the vicinity of the current-inputtable voltage Vi of the second coil part 212. Even if the voltage Vc at the high-voltage-side terminal of the second coil part 212 becomes lower than the current-inputtable voltage Vi, this time period is a moment, and input of a current to the second coil part 212 is hardly delayed. Then, when the gate signal voltage Vg of the ignition control circuit 4 changes to Hi, the voltage Vc at the high-voltage-side terminal of the second coil part 212 is higher than the current-inputtable voltage Vi, and the drain current Ids of the second switching element 61 and the discharge current I2 of the secondary coil 22 immediately start increasing.

The discharge current I2 of the secondary coil 22 is intended to be kept within the intended range Ir between the control lower limit value Imin and the control upper limit value Imax. However, the intended range Ir may be somewhat outside the range between the control lower limit value Imin and the control upper limit value Imax, depending on the switching timing of the second switching element 61.

[Timing Chart of Comparative Embodiment]

In the timing chart of FIG. 8, waveforms of a voltage and a current for a comparative embodiment in which the energy input circuit 6 does not have the soft-off circuit 62 are illustrated with broken lines. In this case, in response to the discharge current I2 of the secondary coil 22 becoming the control upper limit value Imax or more, the second switching element 61 changes from ON to OFF, and the gate voltage Vgs added to the gate G of the second switching element 61 rapidly decreases from Hi to Lo. At this time, the drain current Ids of the second switching element 61 rapidly disappears, and the drain-source voltage Vds of the second switching element 61 and the voltage Vc at the high-voltage-side terminal of the second coil part 212 oscillate to a large extent.

Especially, when the voltage Vc at the high-voltage-side terminal of the second coil part 212 decreases lower than the current-inputtable voltage Vi due to an undershoot of an oscillation of the voltage Vc, start of the increase of the drain current Ids of the second switching element 61 is delayed when the second switching element 61 changes from OFF to ON. As a result, the discharge current I2 of the secondary coil 22 decreases to a large extent, and the discharge current I2 of the secondary coil 22 does not start increasing until the voltage Vc at the high-voltage-side terminal of the second coil part 212 is restored to the current-inputtable voltage Vi or more.

[Operation Effect]

In the present embodiment, the first decreasing stage T1 of decreasing the gate voltage Vgs of the second switching element 61 using the first control resistor 621 and the second control resistor 622 enables electric charges at the gate G of the second switching element 61 to be quickly discharged, so that a time taken for turning off the second switching element 61 is prevented from being extremely lengthened. Also, the second decreasing stage T2 of decreasing the gate voltage Vgs of the second switching element 61 using the second control resistor 622 enables electric charges at the gate G of the second switching element 61 to be slowly discharged, so that an oscillation of the voltage Vc at the high-voltage-side terminal of the second coil part 212 is suppressed, and the fluctuation range of the discharge current I2 of the secondary coil 22 is easily kept small.

Also, since the resistance value of the second control resistor 622 which always discharges electric charges at the gate G of the second switching element 61 is large, leakage of electric charges from the gate G of the second switching element 61 to the second control resistor 622 is suppressed when the second switching element 61 is turned on by the gate signal voltage Vg of the ignition control circuit 4, and a delay at turn-on of the second switching element 61 is suppressed.

Other configurations, operation effects, and others in the ignition device 1 of the present embodiment are the same as in the first embodiment. In the present embodiment, components assigned with identical reference signs to those assigned in the first embodiment are also the same as in the first embodiment.

Third Embodiment

Figure 9:
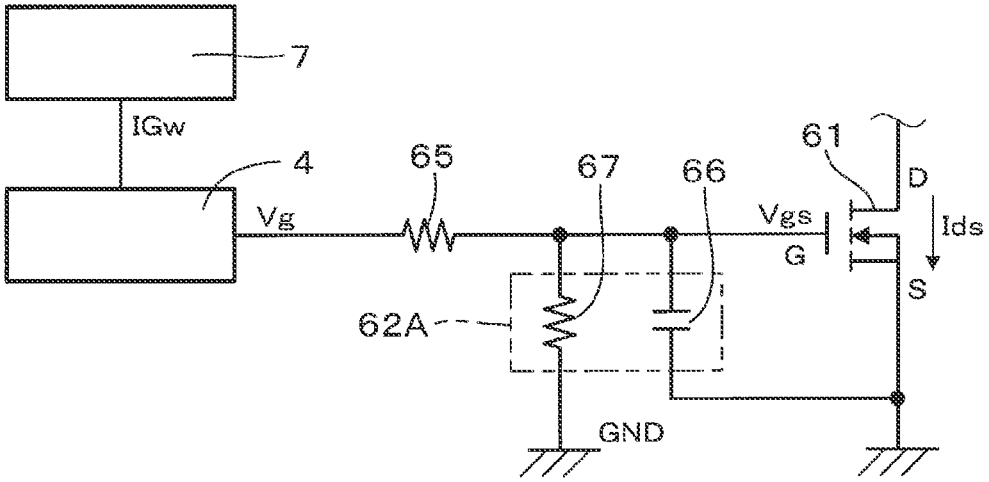
FIG. 9 is a circuit diagram illustrating a configuration of a soft-off circuit of an energy input circuit according to a third embodiment.

In the ignition device 1 of the present embodiment, a case where a condenser 66 connected between the gate and the source of the second switching element 61 is used in a soft-off circuit 62A of the energy input circuit 6, as illustrated in FIG. 9, will be illustrated. Also, a resistor 67 for always discharging electric charges at the gate G of the second switching element 61 is disposed between the gate G of the second switching element 61 and the ground GND. The soft-off circuit 62A of the present embodiment blunts (slows) the rate of decrease of the gate voltage Vgs at turn-off of the second switching element 61 with the time constant by the resistor 67 and the condenser 66.

The soft-off circuit 62A of the energy input circuit 6 of the present embodiment is configured such that the turn-off speed of the second switching element 61 is made slower than the turn-on speed of the second switching element 61.

The ignition device 1 of the present embodiment is also configured such that the gate voltage Vgs as a signal voltage added to the gate G becomes around the threshold voltage Vth in response to turn-off of the second switching element 61. Therefore, the voltage Vc added to the second coil part 212 by the second switching element 61, i.e., the voltage Vc at both ends of the second coil part 212, is kept in a state of being lower than the DC voltage VB of the DC power source 11.

Figure 10:
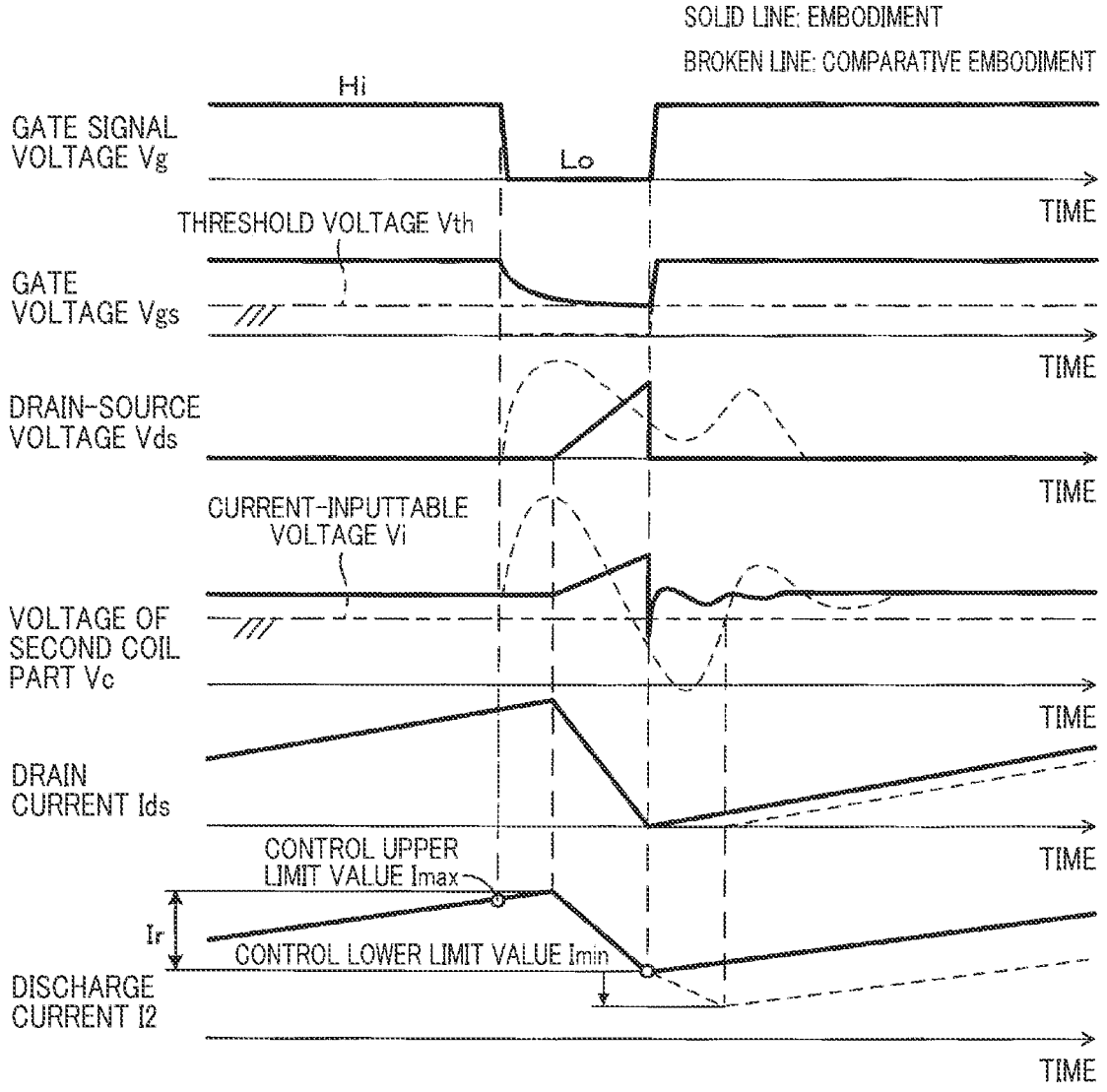
FIG. 10 is a timing chart illustrating an action of maintaining a discharge current of a secondary coil using a second switching element of an energy input circuit according to the third embodiment.

As illustrated in FIG. 10, in the action of the ignition device 1 of the present embodiment, in response to the gate signal voltage Vg of the ignition control circuit 4 changing from Hi to Lo, the gate voltage (gate-source voltage) Vgs of the second switching element 61 rapidly decreases at first and slowly decreases after reaching near the gate-source threshold voltage Vth. In other words, the gate voltage Vgs of the second switching element 61 decreases in a curved manner. Accordingly, the drain-source voltage Vds of the second switching element 61 and the voltage Vc at the high-voltage-side terminal of the second coil part 212 can be slowly increased.

Also, in response to the gate signal voltage Vg of the ignition control circuit 4 changing from Lo to Hi, the gate voltage Vgs of the second switching element 61 quickly increases. Then, since the voltage Vc at the high-voltage-side terminal of the second coil part 212 hardly oscillates, energization to the second coil part 212 can be quickly started.

In the timing chart of FIG. 10, waveforms of a voltage and a current for a comparative embodiment in which the energy input circuit 6 does not have the condenser 66 are also illustrated with broken lines.

Therefore, the ignition device 1 of the present embodiment can also achieve the same operation effect as in the first embodiment. Other configurations in the ignition device 1 of the present embodiment are the same as in the first embodiment. In the present embodiment, components assigned with identical reference signs to those assigned in the first embodiment are also the same as in the first embodiment.

Fourth Embodiment

Figure 11:
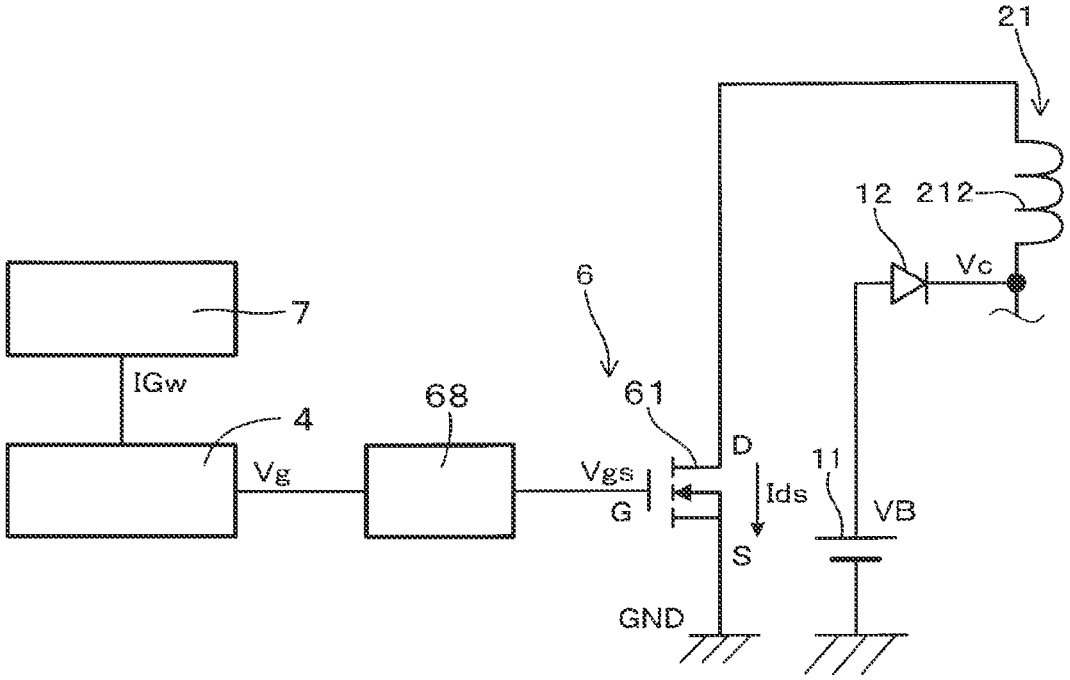
FIG. 11 is a circuit diagram illustrating a configuration of a soft-off circuit of an energy input circuit according to a fourth embodiment.

In the ignition device 1 of the present embodiment, a case where a voltage control circuit 68, configured such that the voltage Vc added to the second coil part 212 by the second switching element 61 maintains a state of being lower than the DC voltage VB of the DC power source 11, is applied to the energy input circuit 6, as illustrated in FIG. 11, will be illustrated. The energy input circuit 6 of the present embodiment has the second switching element 61 and the voltage control circuit 68. The second switching element 61 of the energy input circuit 6 of the present embodiment controls an energization state to the second coil part 212 of the primary coil 21 by the voltage control circuit 68, such that the discharge current I2 in the secondary coil 22 is kept at an intended value directly using the DC voltage VB of the DC power source 11, after the induced electromotive force has been generated.

Figure 12:
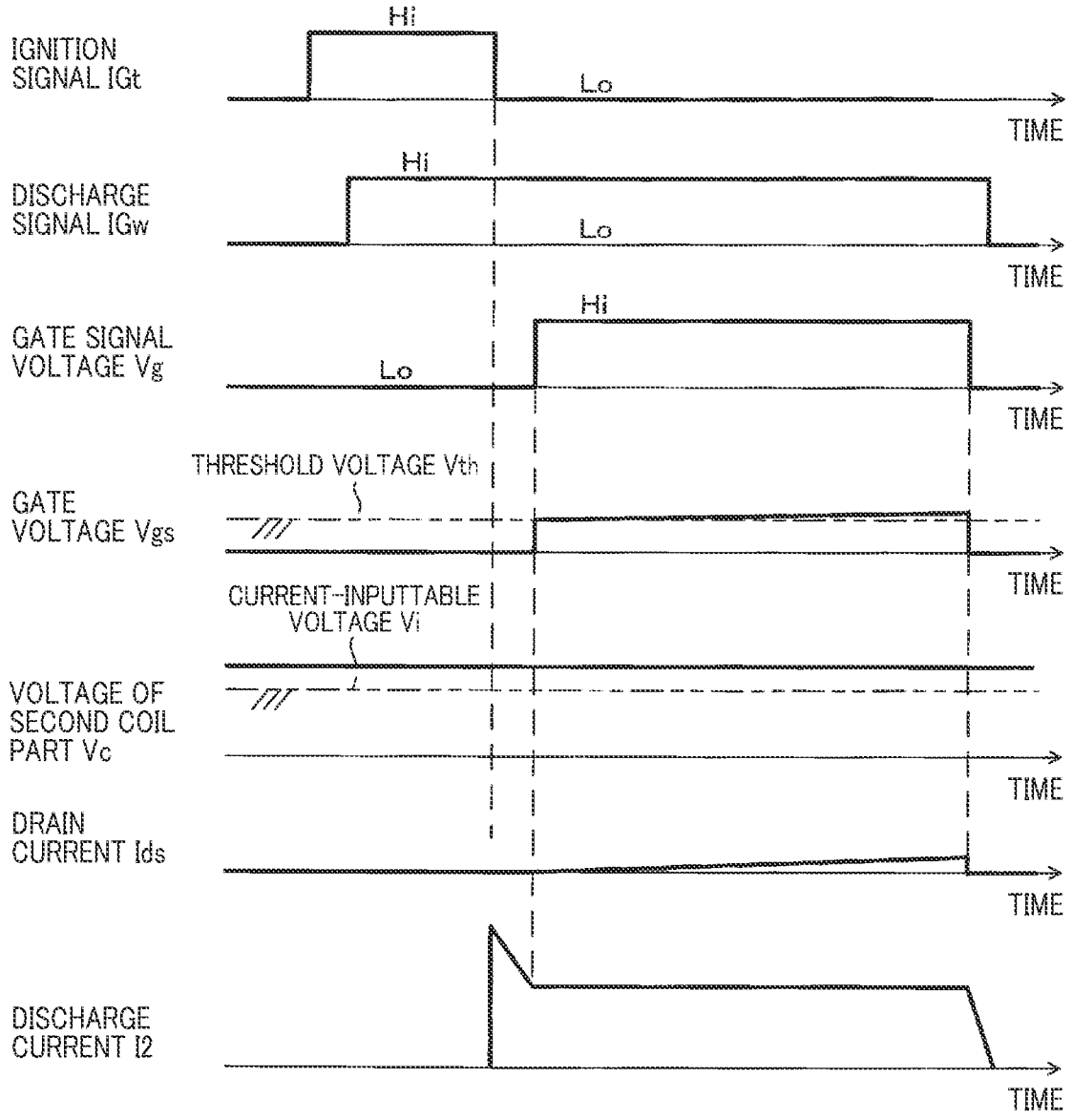
FIG. 12 is a timing chart illustrating an action of an internal combustion engine ignition device in a combustion step of an internal combustion engine according to the fourth embodiment.

As illustrated in FIG. 12, the voltage control circuit 68 is configured to gradually increase the drain current (current flowing between the drain and the source) Ids of the second switching element 61 such that the discharge current I2 in the secondary coil 2 is kept at a certain value. In other words, the voltage control circuit 68 is configured to gradually increase the gate voltage (gate-source voltage) Vgs of the second switching element 61 around the threshold voltage Vth thereby to limit the drain current Ids of the second switching element 61 such that the discharge current I2 in the secondary coil 22 is kept at a certain value. The voltage control circuit 68 functions as a linear regulator that dulls the gate voltage Vgs added to the gate G of the second switching element 61 for maintaining a state in which the second switching element 61 does not completely become on.

After the discharge current I2 has been generated in the secondary coil 22 by interruption of energization to the first coil part 211 of the primary coil 21, this discharge current I2 gradually decreases unless energy is newly input to the primary coil 21. In the first to third embodiments, a current to energize the second coil part 212 of the primary coil 21 was intermittently controlled such that the discharge current I2 changes between the control upper limit value Imax and the control lower limit value Imin. On the other hand, in the present embodiment, the current I1 to energize the second coil part 212 of the primary coil 21 is gradually increased in association with a speed at which the discharge current I2 gradually decreases, such that the change of the discharge current I2 decreases.

Figure 13:
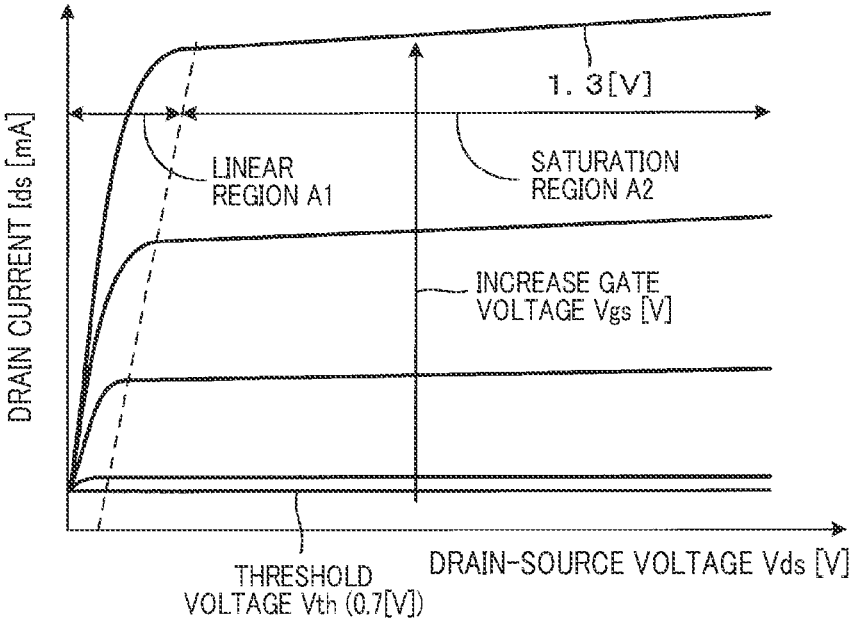
FIG. 13 is a graph illustrating a relationship between a drain-source voltage and a drain current according to the fourth embodiment.

The second switching element 61 is constituted by a MOSFET. As illustrated in FIG. 13, when the gate voltage Vgs of the MOSFET is, for example, in a range of 0.7 V to 1.3 V as the vicinity of the threshold voltage Vth, a relationship between the drain-source voltage Vds and the drain current (drain-source current) Ids in the MOSFET forms a linear region A1 and a saturation region A2. The linear region A1 indicates a region where the drain current Ids increases as the drain-source voltage Vds increases while the drain-source voltage Vds is around low. The saturation region A2 indicates a region where the drain current Ids does not increase much even when the drain-source voltage Vds increases.

Also, in the saturation region A2, when the gate voltage Vgs increases, for example, from 0.7 V to 1.3 V, the drain current Ids increases as the gate voltage Vgs increases. Then, as illustrated in FIG. 12, the voltage control circuit 68 of the present embodiment forms a state in which the gate voltage Vgs added to the gate G of the second switching element 61 gradually increases in the vicinity of the threshold voltage Vth such that the drain current Ids of the second switching element 61 gradually increases, by taking advantage of the saturation region A2 of the MOSFET.

In the present embodiment, a state in which the second switching element 61 becomes incompletely on around the threshold voltage Vth of the gate G is formed, without performing on or off of the second switching element 61, i.e., without performing energization and interruption of energization of the second switching element 61. This enables the voltage Vc at the high-voltage-side terminal of the second coil part 212 of the primary coil 21 to hardly oscillate, and thus not to become lower than the current-inputtable voltage Vi.

Then, the discharge current I2 of the secondary coil 22 is kept at an intended current value in response to input of electric energy to the second coil part 212 of the primary coil 21, so that the input amount of a current to the second coil part 212 is adequately controlled. This reduces consumption of electric energy for continuing the discharge current I2 of the secondary coil 22.

Therefore, according to the internal combustion engine ignition device 1 of the present embodiment, input of a current to the primary coil 21 for continuing the discharge current I2 of the secondary coil 22 is also adequately performed while suppressing consumption of electric energy. Other configurations and operation effects in the ignition device 1 of the present embodiment are the same as in the first embodiment. Also, in the present embodiment, components assigned with identical reference signs to those assigned in the first embodiment are the same as in the first embodiment.

Other Embodiments

The first coil part 211 and the second coil part 212 of the primary coil 21 can also be formed as the entirety of the primary coil 21.

The present disclosure is not limited to only the embodiments, and further different embodiments can be configured within the scope that does not depart from the gist thereof. Also, the present disclosure includes various variation examples, variation examples within the equivalent scope, and others. Furthermore, various combinations of constituents, embodiments, and others, which are assumed from the present disclosure, are also included in the technical idea of the present disclosure.

What is claimed is:

1. An internal combustion engine ignition device comprising:

an ignition coil having a primary coil to be applied with a DC voltage by a DC power source and a secondary coil to generate an induced electromotive force in response to interruption of energization to the primary coil;

an ignition plug for generating a spark discharge in a combustion chamber of an internal combustion engine by the induced electromotive force;

a main ignition circuit having a first switching element that performs energization and interruption of energization to a first coil part, which constitutes at least a portion of the primary coil, for generating the induced electromotive force using the DC voltage; and an energy input circuit having a second switching element that performs energization and interruption of energization to a second coil part, which constitutes at least a portion of the primary coil, for keeping a discharge current in the secondary coil within an intended range directly using the DC voltage after the induced electromotive force has been generated, and a soft-off circuit to slow a turn-off speed of the second switching element, wherein the energy input circuit is configured to, when decreasing a signal voltage added to a gate of the second switching element, execute a first decreasing stage of decreasing the signal voltage until it reaches the vicinity of a gate-source threshold voltage and a second decreasing stage of gradually decreasing the signal voltage in the vicinity of the threshold voltage.

2. The internal combustion engine ignition device according to claim 1, wherein the energy input circuit includes two types of control resistors having different resistance values connected to the gate of the second switching element, and is configured to decrease a signal voltage added to the gate of the second switching element using the first control resistor having a lower resistance value in the first decreasing stage and decrease a signal voltage added to the gate of the second switching element using the second control resistor having a higher resistance value in the second decreasing stage.

3. An internal combustion engine ignition device comprising:

an ignition coil having a primary coil to be applied with a DC voltage by a DC power source and a secondary coil to generate an induced electromotive force in response to interruption of energization to the primary coil;

an ignition plug for generating a spark discharge in a combustion chamber of an internal combustion engine by the induced electromotive force;

a main ignition circuit having a first switching element that performs energization and interruption of energization to a first coil part, which constitutes at least a portion of the primary coil, for generating the induced electromotive force using the DC voltage; and an energy input circuit having a second switching element that performs energization and interruption of energization to a second coil part, which constitutes at least a portion of the primary coil, for keeping a discharge current in the secondary coil within an intended range directly using the DC voltage after the induced electromotive force has been generated, the energy input circuit being configured to make a turn-off speed of the second switching element slower than a turn-on speed of the second switching element, wherein the energy input circuit is configured to, when decreasing a signal voltage added to a gate of the second switching element, execute a first decreasing stage of decreasing the signal voltage until it reaches the vicinity of a gate-source threshold voltage and a second decreasing stage of gradually decreasing the signal voltage in the vicinity of the threshold voltage.

4. The internal combustion engine ignition device according to claim 3, wherein the energy input circuit includes two types of control resistors having different resistance values connected to the gate of the second switching element, and is configured to decrease a signal voltage added to the gate of the second switching element using the first control resistor having a lower resistance value in the first decreasing stage and decrease a signal voltage added to the gate of the second switching element using the second control resistor having a higher resistance value in the second decreasing stage.

5. An internal combustion engine ignition device comprising:

an ignition coil having a primary coil to be applied with a DC voltage by a DC power source and a secondary coil to generate an induced electromotive force in response to interruption of energization to the primary coil;

an ignition plug for generating a spark discharge in a combustion chamber of an internal combustion engine by the induced electromotive force;

a main ignition circuit having a first switching element that performs energization and interruption of energization to a first coil part, which constitutes at least a portion of the primary coil, for generating the induced electromotive force using the DC voltage; and an energy input circuit having a second switching element that controls an energization state to a second coil part, which constitutes at least a portion of the primary coil, for keeping a discharge current in the secondary coil at an intended value directly using the DC voltage after the induced electromotive force has been generated, the energy input circuit being configured to keep a voltage applied to the second coil part by the second switching element in a state of being lower than the DC voltage, wherein the energy input circuit is configured to gradually increase a gate-source voltage of the second switching element in the vicinity of a threshold voltage thereby to limit and gradually increase a current flowing between the drain and the source of the second switching element, such that the discharge current of the secondary coil is kept at a certain value.

* * * * *